US011161318B2

(12) United States Patent
Grünwald et al.

(10) Patent No.: US 11,161,318 B2
(45) Date of Patent: Nov. 2, 2021

(54) CORRUGATED CARDBOARD PLANT

(71) Applicant: BHS Corrugated Maschinen- und Anlagenbau GmbH, Weiherhammer (DE)

(72) Inventors: Gerhard Grünwald, Freudenberg (DE); Maximilian Mark, Tirschenreuth (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 101 days.

(21) Appl. No.: 16/092,914

(22) PCT Filed: Mar. 28, 2017

(86) PCT No.: PCT/EP2017/057331
§ 371 (c)(1),
(2) Date: Oct. 11, 2018

(87) PCT Pub. No.: WO2017/178228
PCT Pub. Date: Oct. 19, 2017

(65) Prior Publication Data

US 2019/0084266 A1 Mar. 21, 2019

(30) Foreign Application Priority Data

Apr. 12, 2016 (DE) ..... 10 2016 206 016.3

(51) Int. Cl.
*B31F 1/00* (2006.01)
*B31F 1/28* (2006.01)

(52) U.S. Cl.
CPC ..... *B31F 1/2831* (2013.01); *B31F 1/2804* (2013.01); *B31F 1/285* (2013.01); *B31F 1/2813* (2013.01); *B31F 1/2818* (2013.01)

(58) Field of Classification Search
CPC ..... B31F 1/2831; B31F 1/2804
See application file for complete search history.

(56) References Cited

U.S. PATENT DOCUMENTS 4,288,273 A * 9/1981 Butler, Jr. ..... B31F 1/2836 156/361
4,566,922 A * 1/1986 Martinez ..... B31F 1/20 156/159

(Continued)

FOREIGN PATENT DOCUMENTS

CN 1216951 A 5/1999
CN 101018665 A 8/2007

(Continued)

*Primary Examiner* — Eyamindae C Jallow
(74) *Attorney, Agent, or Firm* — McGlew and Tuttle, P.C.

(57) ABSTRACT

A corrugated cardboard plant, including at least one corrugated cardboard production device for producing at least one corrugated cardboard web laminated on one side, having a respective corrugated web and a cover web; a connection device, disposed downstream of the at least one corrugated cardboard production device, for connecting the at least one corrugated cardboard web laminated on one side and a lamination web to one another, while forming an at least three-ply corrugated cardboard web; at least one cutting device for generating corrugated cardboard sheets from the at least three-ply corrugated cardboard web; and at least one individual code reading device for reading corrugated cardboard sheet individual codes on at least one of the webs of the at least three-ply corrugated cardboard web and/or on at least one of the webs for forming the at least three-ply corrugated cardboard web and/or on the corrugated cardboard sheets.

21 Claims, 3 Drawing Sheets

(56) References Cited

U.S. PATENT DOCUMENTS

| | | | | |
|---|---|---|---|---|
| 5,325,306 | A | 6/1994 | Adachi et al. | |
| 5,783,006 | A * | 7/1998 | Klockenkemper | B31F 1/2831 156/64 |
| 5,951,817 | A * | 9/1999 | Thomas | B31F 1/2877 156/470 |
| 6,139,938 | A * | 10/2000 | Lingle | B31F 1/28 428/182 |
| 6,602,546 | B1 * | 8/2003 | Kohler | B31F 1/2818 427/207.1 |
| 2002/0053187 | A1 * | 5/2002 | O'Connor | B65D 85/67 53/429 |
| 2006/0148631 | A1 * | 7/2006 | Protocsnak | B31F 1/2822 493/463 |
| 2006/0278342 | A1 * | 12/2006 | Baierl | B31F 1/2831 156/378 |
| 2011/0284146 | A1 * | 11/2011 | Hirtreiter | B31F 1/2831 156/64 |
| 2015/0034455 | A1 * | 2/2015 | Ragan | B65G 17/24 198/617 |
| 2015/0148940 | A1 * | 5/2015 | Ben-David | B31B 1/74 700/218 |
| 2016/0009516 | A1 * | 1/2016 | Mark | B41J 3/407 493/13 |
| 2016/0075518 | A1 * | 3/2016 | Itoh | G01M 99/00 198/502.4 |
| 2017/0088380 | A1 | 3/2017 | Mark et al. | |
| 2018/0079162 | A1 * | 3/2018 | Adami | B31F 1/2831 |

FOREIGN PATENT DOCUMENTS

| | | | | |
|---|---|---|---|---|
| CN | 101115661 | A | 1/2008 | |
| DE | 41 22 600 | A1 | 1/1992 | |
| DE | 44 35 212 | A1 | 4/1995 | |
| DE | 103 12 601 | A1 | 9/2004 | |
| DE | 10 2007 027 879 | A1 | 1/2009 | |
| DE | 10 2007 054 194 | B3 | 5/2009 | |
| DE | 10 2015 218 321 | A1 | 3/2017 | |
| EP | 1 459 878 | A2 | 9/2004 | |
| EP | 1459878 | A2 * | 9/2004 | B31F 1/2822 |
| WO | 2006/093447 | A1 | 9/2006 | |
| WO | 2017/051146 | A1 | 3/2017 | |

* cited by examiner

CORRUGATED CARDBOARD PLANT

CROSS REFERENCE TO RELATED APPLICATIONS

This application is a United States National Phase Application of International Application PCT/EP2017/057331, filed Mar. 28, 2017, and claims the benefit of priority under 35 U.S.C. § 119 of German Patent Application Serial No. DE 10 2016 206 016.3, filed Apr. 12, 2016, the entire contents of which are incorporated herein by reference.

TECHNICAL FIELD

The present invention relates to a corrugated cardboard plant for producing corrugated cardboard. The present invention is furthermore directed toward a method for producing corrugated cardboard.

BACKGROUND

Corrugated cardboard plants are generally known from the prior art by way of obvious prior utilization. Said corrugated cardboard plants are capable of generating large quantities of corrugated cardboard sheets. DE 10 2007 027 879 A1, DE 44 35 212 A1, DE 41 22 600 A1, DE 103 12 601 A1 and DE 10 2007 054 194 B3 disclose corrugated cardboard plants of the generic type.

SUMMARY OF THE INVENTION

The invention is based on the object of providing a corrugated cardboard plant which permits an extremely economical and simple production of individualized or individual, respectively, corrugated cardboard sheets. A respective method is moreover to be achieved.

This object is achieved according to the invention by a corrugated cardboard plant, comprising at least one corrugated cardboard production device for producing at least one corrugated cardboard web laminated on one side, having a respective corrugated web and cover web; a connection device, disposed downstream of the at least one corrugated cardboard production device, for connecting the at least one corrugated cardboard web laminated on one side and a lamination web to one another, while forming an at least three-ply corrugated cardboard web; and at least one cutting device for generating corrugated cardboard sheets from the at least three-ply corrugated cardboard web, comprising at least one individual code reading device for reading corrugated cardboard sheet individual codes on at least one of the webs of the at least three-ply corrugated cardboard web and/or on at least one of the webs for forming the at least three-ply corrugated cardboard web and/or on the corrugated cardboard sheets.

Furthermore, this object is achieved by a method for producing corrugated cardboard, comprising the steps of producing at least one corrugated cardboard web laminated on one side, having a respective corrugated web and cover web, by means of at least one corrugated cardboard production device; connecting the at least one corrugated cardboard web laminated on one side and a lamination web to one another, while forming an at least three-ply corrugated cardboard web, by means of a connection device disposed downstream of the at least one corrugated cardboard production device; generating corrugated cardboard sheets from the at least three-ply corrugated cardboard web by means of at least one cutting device; and reading corrugated cardboard sheet individual codes on at least one of the webs of the at least three-ply corrugated cardboard web and/or on at least one of the webs for forming the at least three-ply corrugated cardboard web and/or on the corrugated cardboard sheets by means of at least one individual code reading device.

The core concept of the invention lies in that the at least three-ply corrugated cardboard web, or at least one web, in particular the lamination web and/or the cover web, respectively, for forming the same, in particularly externally, has/have individual, in particular two-dimensional, corrugated cardboard sheet individual codes, or corrugated cardboard sheet individual code imprints, which in each case include at least one item of useful information.

The corrugated cardboard sheet individual codes can per se include directly the items of useful information, for example. It is expedient for the corrugated cardboard sheet individual codes to represent information carriers, the at least one item of (useful) information thereof preferably being readable on demand, and/or the at least one item of (useful) information thereof being allocatable at least one further/new item of information.

According to one preferred embodiment it is possible that at least one, in particular static, item of information according to a nomenclature is stored directly in the corrugated cardboard sheet individual codes. In the case of a comparatively high data depth and/or unconditional uniqueness, the corrugated cardboard sheet individual code favorably represents/establishes only a connection/link to a, for example superordinate, database where preferably at least one item of useful information is stored and preferably (dynamically) modifiable or expandable, respectively. The corrugated cardboard sheet individual code in this instance includes the useful information in a quasi-indirect manner.

It is advantageous for the corrugated cardboard sheet individual codes to be machine-readable, in particular in an optical or opto-electronic manner, and to be capable of being further processed, favorably in an electronic manner.

The at least one individual code reading device is favorably embodied as an optical individual code reading device. Said at least one individual code reading device is configured, for example, as a scanner and/or a camera or the like. The at least one individual code reading device serves in particular for reading preferably two-dimensional corrugated cardboard sheet individual codes.

It is advantageous for the at least one individual code reading device to be configured as an individual code line reading device or line scan camera, respectively. The entire width of the at least one web that has the corrugated cardboard sheet individual codes is preferably thus capable of being inspected or checked, respectively, in particular in a planar manner, in terms of corrugated cardboard sheet individual codes. Alternatively, at least two individual code line reading devices are disposed beside one another, for example, in order for the entire width of the at least one web that has the corrugated cardboard sheet individual codes to be inspected or checked, respectively, in particular in a planar manner, in terms of corrugated cardboard sheet individual codes. The individual code line reading devices are thus favorably disposed beside one another in the transverse direction of said web. Dissimilar corrugated cardboard sheet individual codes are thus detectable.

It is advantageous for any scanning of the at least one web that is provided with corrugated cardboard sheet individual codes to be performed across the entire width of said web, or across the entire area, respectively, for example by way of a line scan camera. In particular, a plurality of corrugated cardboard sheet individual codes can in this instance be simultaneously read. Said corrugated cardboard sheet individual codes can be disposed so as to be distributed across the entire width of the web, for example, and in particular appear on each web that is provided with corrugated cardboard sheet individual codes. When reading is performed by way of a line scan camera, the pre-positioning of individual cameras in the context of traversing the width of the web in particular becomes dispensable herein.

It is expedient for the at least one individual code reading device to comprise at least one image sensor, in particular a CMOS sensor, a CCD (charge-coupled device) sensor, and/or a CIS (contact image sensor), or for said at least one individual code reading device to utilize a respective technology.

The in particular imprinted corrugated cardboard sheet individual codes are favorably permanently visible. Said corrugated cardboard sheet individual codes are optically distinguishable in relation to the background. Said corrugated cardboard sheet individual codes preferably include dark printing ink, such as black printing ink. It is advantageous for said corrugated cardboard sheet individual codes to also include light (printing) ink/(printed) regions, such as white or brown (printing) ink/(printed) regions.

The connection device is preferably embodied as a heating and tensioning section, or as a heating/pressing device.

The at least one cutting device is preferably embodied as a transverse cutting device.

The at least one corrugated cardboard production device preferably comprises in each case one grooving installation for grooving a material web to be corrugated, while forming a corrugated web. Said at least one corrugated cardboard production device moreover favorably has a glue application installation for gluing the corrugated web. It is advantageous for the at least one corrugated cardboard production device moreover to comprise a contact pressure installation for pressing a respective cover web against the corrugated web provided with glue.

The lamination web is favorably a smooth material web. Said lamination web in the case of the corrugated cardboard sheets, or of the at least three-ply corrugated cardboard web, respectively, preferably forms an external ply.

In the case of the at least three-ply corrugated cardboard web, or of the corrugated cardboard sheets, respectively, the individual webs or plies, respectively, are favorably glued to one another in the manner of layers.

In particular, three-ply, five-ply, or seven-ply corrugated cardboard sheets are producible by way of the corrugated cardboard plant.

The terms "disposed upstream", "disposed downstream", "upstream", "downstream" or the like used herein relate in particular to the respective conveyed web, or the conveyed sheet, respectively.

The at least one individual code printing device disposed upstream of the at least one cutting device for printing at least one of the webs of the at least three-ply corrugated cardboard web and/or at least one of the webs for forming the at least three-ply corrugated cardboard web having corrugated cardboard sheet individual codes, wherein preferably the at least one individual code printing device is preferably disposed in an individual code imprinting line, is favorably configured as an individual code digital printing device. Said individual code digital printing device thus functions without any static printing plate. The respective corrugated cardboard individual code imprints in this instance can be transferred directly to the at least one individual code printing device. The at least one individual code printing device is configured, for example, as an ink jet individual code printing device or a laser individual code printing device.

The at least one individual code printing device is preferably assigned to the lamination web in order for the latter to be imprinted, in particular on the external side, with the corrugated cardboard sheet individual codes. The lamination web is printable in an extremely positive and simple manner. It can thus be particularly reliably avoided that the further processing in the corrugated cardboard plant damages the corrugated cardboard sheet individual codes or renders said corrugated cardboard sheet individual codes illegible, respectively.

It is advantageous for the at least one individual code printing device to be disposed upstream of the connection device, in particular upstream of a gluing unit for applying glue to at least one of the webs for forming the at least three-ply corrugated cardboard web.

The at least one individual code printing device is in particular disposed in an individual code imprinting line, wherein the individual code web printed therein is later transferred to a corrugated cardboard production line. The infed individual code web in the case of the at least three-ply corrugated cardboard web, or the corrugated cardboard sheets, respectively, forms the lamination web. The individual code web can be optionally or permanently processed.

Alternatively, the at least one individual code printing device is integrated, for example, in a corrugated cardboard production line and fixedly assigned to the lamination web.

Alternatively, an external cover web of the at least three-ply corrugated cardboard web, or a cover web for forming the at least three-ply corrugated cardboard web, respectively, is imprinted with corrugated cardboard sheet individual codes on the external side.

It is expedient for the at least one individual code printing device to be capable of imprinting the corrugated cardboard sheet individual codes at least in a uni-dimensional manner, preferably a two-dimensional manner. The at least one individual code printing device when in operation prints, or generates, respectively, at least uni-dimensional, preferably two-dimensional, corrugated cardboard sheet individual codes. It is advantageous for the corrugated cardboard sheet individual codes to be readable independently of the alignment of said codes in a respective reading field. The corrugated cardboard sheet individual codes favorably include at least one error correction and/or error identification.

The at least one individual code printing device favourably imprints at least one of the webs of the at least three-ply corrugated cardboard web and/or at least one of the webs for forming the at least three-ply corrugated cardboard web in such a manner that each corrugated cardboard sheet has at least one of the corrugated cardboard sheet individual codes.

It is expedient for uni-dimensional corrugated cardboard sheet individual codes to have a series of preferably black lines on a light, preferably white or brown, background. The uni-dimensional corrugated cardboard sheet individual codes are favorably configured as dual-width individual codes or multiple-width individual codes.

The at least one individual code printing device however preferably generates two-dimensional corrugated cardboard sheet individual codes. The items of useful information are accordingly coded in the form of areas. The items of useful information are thus able to be coded in an extremely compact manner. The two-dimensional corrugated cardboard sheet individual codes in this instance consequently have a particularly high density in terms of useful information. The two-dimensional corrugated cardboard sheet individual codes preferably have bars and/or dots of dissimilar widths and gaps lying therebetween which preferably have a high contrast in relation to the bars or dots, respectively. The corrugated cardboard sheet individual codes are favourably embodied as matrix codes, in particular data matrix codes. Alternatively, other, in particular two-dimensional, corrugated cardboard sheet individual codes such as stacked codes can be used. A QR code can also be alternatively used, for example. The QR code favourably represents/establishes a reference to a, for example superordinate, database. The code in this instance is preferably free of useful information. The corrugated cardboard plant is preferably capable of allocating items of information to the corrugated cardboard sheet individual codes. To this end, the corrugated cardboard plant favorably has at least one respective allocation unit.

It is advantageous for the at least one stocking installation for stocking at least one web already provided with corrugated cardboard sheet individual codes, as a component part of the at least three-ply corrugated cardboard web, wherein providing the at least one web with corrugated cardboard sheet individual codes is preferably performed outside a corrugated cardboard production line or the corrugated cardboard plant, to comprise at least one reserve roll having a web provided with the corrugated cardboard sheet individual codes.

It is advantageous for at least one upstream process/step, such as preprinting of at least one web or roll, respectively, of the corrugated cardboard plant, or of a corrugated cardboard production line, respectively, to make available or deliver, respectively, at least one necessary or expedient, respectively, item of information, in particular in terms of processing and/or further processing of at least one web, or of a corrugated cardboard sheet, respectively. For example, pre-printing is performed in an in particular continuous procedure, a so-called machine pass, that is coupled to the production of the corrugated cardboard, or in a separate upstream machine pass. In the case of a separate upstream machine pass, it is expedient for the web(s) provided with the corrugated cardboard sheet individual codes to first be wound up again, then be transported to the corrugated cardboard plant or corrugated cardboard production line, respectively, and then to be unwound for processing/further processing. The corrugated cardboard plant or corrugated cardboard production line, respectively, in this case preferably uses the web(s) provided with corrugated cardboard sheet individual codes. An overall arrangement in this instance favorably includes the corrugated cardboard plant and at least one upstream pre-printing installation.

The design embodiment configured such that the corrugated cardboard sheet individual codes of at least two of the corrugated cardboard sheets differ from one another, in particular in terms of the useful information thereof included, leads to corrugated cardboard sheets which are provided, in particularly imprinted, individually with at least one, in particular characteristic, corrugated cardboard sheet individual code. In particular, each corrugated cardboard sheet individual code is adapted to the processing or production, respectively, of said corrugated cardboard sheet according to the associated order. The point of differentiation preferably lies in the useful information contained or in the dissimilar reference.

According to one preferred embodiment, at least one corrugated cardboard plant control device that in terms of information is connected to the at least one individual code reading device is present. Items of useful information that are connected with the corrugated cardboard sheet individual codes can be further processed in the at least one individual code reading device and/or corrugated cardboard plant control device, for example. The respective connection in terms of information can be configured so as to be wireless or wired.

For example, at least one, preferably at least some, for example all, individual code reading device/devices is/are assigned a dedicated corrugated cardboard plant control device. Alternatively and/or additionally, at least two individual code reading devices are connected in terms of information to a superordinate corrugated cardboard plant control device. Combinations are possible.

The at least one corrugated cardboard plant control device in terms of information is preferably connected to at least one processing device for processing the at least three-ply corrugated cardboard web and/or at least one of the webs for forming the at least three-ply corrugated cardboard web and/or the at least one corrugated cardboard sheet. This design embodiment permits a very economical individual processing, or corrugated cardboard sheets that are produced individually in a very economical manner, respectively. The at least one processing device is favorably configured as a corrugated cardboard plant processing device or corrugated cardboard sheet processing/handling device.

The design embodiment configured such that the at least one corrugated cardboard plant control device is capable of tracking the corrugated cardboard sheet individual codes enables a particularly simple and functionally reliable (retrospective) tracking of a web portion of the at least three-ply corrugated cardboard web that has said at least one cardboard corrugated cardboard sheet individual code, or of at least one web for forming the at least three-ply corrugated web, respectively, or of the respective corrugated cardboard sheet, respectively. The corrugated cardboard sheets are favourably trackable both in terms of the production thereof as well as in terms of further processing or handling steps, respectively. For example, it can thus be established where a web portion of the at least three-ply corrugated cardboard web that has said at least one corrugated cardboard sheet individual code, or the respective corrugated cardboard sheet, respectively, is currently located.

An individual processing in a particularly simple and functionally reliable manner is possible on account of the design embodiment configured such that the at least one corrugated cardboard plant control device actuates individually at least one processing device, in particular of the corrugated cardboard plant, in a manner corresponding to the at least one read corrugated cardboard sheet individual code. A processing device is thus able to be readjusted in an extremely simple manner. This is favorably possible in a particularly short time frame. For example, a corresponding, in particular direct, adjustment/readjustment of an individual processing device or of a group of processing devices is performed depending on the read corrugated cardboard sheet individual code. In this instance, the at least one corrugated cardboard plant control device, according to the at least one read corrugated cardboard sheet individual code, in particular actuates individually, in particular directly, at least one processing device which is assigned to the respective individual code reading device, or is disposed downstream of the latter, respectively.

It is advantageous for an individual code reading device to be disposed, in particular directly, upstream of at least one, more preferably a plurality of, more preferably all, processing device(s), or to be assigned to the latter.

In the case of the pre-heating device, which is actuable by the at least one corrugated cardboard plant control device for pre-heating at least one web for forming the at least three-ply corrugated cardboard web in a manner corresponding to the at least one read associated corrugated cardboard sheet individual code, wherein the pre-heating device is preferably assigned at least one, in particular upstream, individual code reading device, the heating and/or the temperature of the at least one web to be heated is in particular variable in an individual manner.

It is expedient for the quantity of glue and/or the width of the glue that is to be applied on the at least one web to be glued, for example, to be variable in an individual manner in the case of the gluing unit, which is actuable by the at least one corrugated cardboard plant control device for applying glue to at least one web for forming the at least three-ply corrugated cardboard web in a manner corresponding to the at least one read associated corrugated cardboard sheet individual code, wherein the gluing unit is preferably assigned at least one, in particular upstream, individual code reading device.

In the case of the connection device, which is actuable by the at least one corrugated cardboard plant control device in a manner corresponding to the at least one read associated corrugated cardboard sheet individual code, the connection device preferably being assigned at least one, in particular upstream, individual code reading device, the heating temperature, the web temperature, and/or the contact pressure, for example, are/is variable in an individual manner.

It is advantageous for the (format) length of the corrugated cardboard sheet to be generated to be variable in an individual manner in the case of the cutting device, which is individually actuable by the at least one corrugated cardboard plant control device in a manner corresponding to the at least one read associated corrugated cardboard sheet individual code, in particular so as to divert a defective corrugated cardboard sheet, the cutting device preferably being assigned at least one, in particular upstream, individual code reading device. The cutting device is favorably capable of assigning the corrugated cardboard sheets to different planes and/or to different stacks.

By way of the short transverse cutting device, which is individually actuable by the at least one corrugated cardboard plant control device for diverting a defective piece of the at least three-ply corrugated cardboard web in a manner corresponding to the at least one read associated corrugated cardboard sheet individual code, wherein the short transverse cutting device is preferably assigned at least one, in particular upstream, individual code reading device, a defective corrugated cardboard piece can be individually cut out from the at least three-ply corrugated cardboard web and diverted away from the corrugated cardboard plant, for example. In particular, only defective corrugated cardboard pieces are diverted. The defective corrugated cardboard piece is, for example, identifiable on account of an interaction with at least one processing device which is disposed upstream of the short transverse cutting device. The defective corrugated cardboard piece is, for example, identifiable on account of an interaction with an individual code reading device which is disposed upstream of the short transverse cutting device.

It is advantageous for the at least one corrugated cardboard plant control device, which is capable of automatically issuing an order for reproducing the defective, in particular diverted, piece of the at least three-ply corrugated cardboard web, when diverting in a defective corrugated cardboard piece to automatically issue a new order for the renewed faultless fabrication of said corrugated cardboard piece. The defective corrugated cardboard piece can have, for example, an adhesive-bonding error, a printing error, and/or a defective dimension. It is advantageous in this instance for it to be retrievable from the corrugated cardboard sheet individual code that this is a defective corrugated cardboard piece. It is advantageous for a lack of recognition, an illegibility and/or a poor legibility of the respective corrugated cardboard sheet individual code to lead to the diversion of the respective corrugated cardboard piece.

The (format) width of the corrugated cardboard sheet, or of part-webs that emanate therefrom, respectively, is favorably variable in an individual manner by way of the longitudinal cutting/grooving device, which is individually actuable by the at least one corrugated cardboard plant control device for longitudinally cutting and grooving the at least three-ply corrugated cardboard web in a manner corresponding to the at least one read associated corrugated cardboard sheet individual code, wherein the longitudinal cutting/grooving device is preferably assigned at least one, in particular upstream, individual code reading device.

It is expedient for a respective (transverse) position of the corrugated cardboard sheet individual codes to be determined/measured, and for a comparison with a nominal position of the corrugated cardboard sheet individual codes to be performed. The respective corrugated cardboard sheet individual code preferably ensures, in particular per se, that at least one processing device is controlled in a corrective manner, depending on the current position of the respective web. This preferably replaces other separate printed elements for guiding cutting or grooving tools, respectively, in a corrective manner.

It is expedient for a stack height of stacked corrugated cardboard sheets, for example, to be adjustable in an individual manner by way of the at least one corrugated cardboard sheet depositing device, which is individually actuable by the at least one corrugated cardboard plant control device for depositing the corrugated cardboard sheets in a manner corresponding to the at least one read associated corrugated cardboard sheet individual code, wherein the at least one corrugated cardboard sheet depositing device is preferably assigned at least one, in particular upstream, individual code reading device.

In the case of the corrugated cardboard sheet stacking device, which is individually actuable by the at least one corrugated cardboard plant control device for handling the corrugated cardboard sheets stacked in at least one stack in a manner corresponding to the at least one read associated corrugated cardboard sheet individual code, wherein the stack handling device is preferably assigned at least one individual code reading device, the diversion of generated stacks away from the corrugated cardboard plant is favorably adaptable/controllable in an individual manner.

The at least one corrugated cardboard sheet individual code imprinted on the corrugated cardboard sheet favourably has at least one item of control information for controlling a pre-heating device for pre-heating at least one web for forming the at least three-ply corrugated cardboard web.

It is advantageous for the at least one corrugated cardboard sheet individual code imprinted on the corrugated cardboard sheet to have at least one item of control information for controlling a gluing unit for applying glue to at least one web for forming the at least three-ply corrugated cardboard web.

The at least one corrugated cardboard sheet individual code imprinted on the corrugated cardboard sheet preferably has at least one item of control information for controlling the connection device, at least one item of control information for controlling a short transverse cutting device for transversely cutting the at least three-ply corrugated cardboard web and for diverting a, preferably defective, corrugated cardboard piece, at least one item of control information for controlling a longitudinal cutting/grooving device for longitudinally cutting and grooving the at least three-ply corrugated cardboard web, at least one item of control information for controlling the cutting device, at least one item of control information for controlling at least one corrugated cardboard sheet depositing device, and/or at least one item of control information for controlling a corrugated cardboard sheet stacking device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
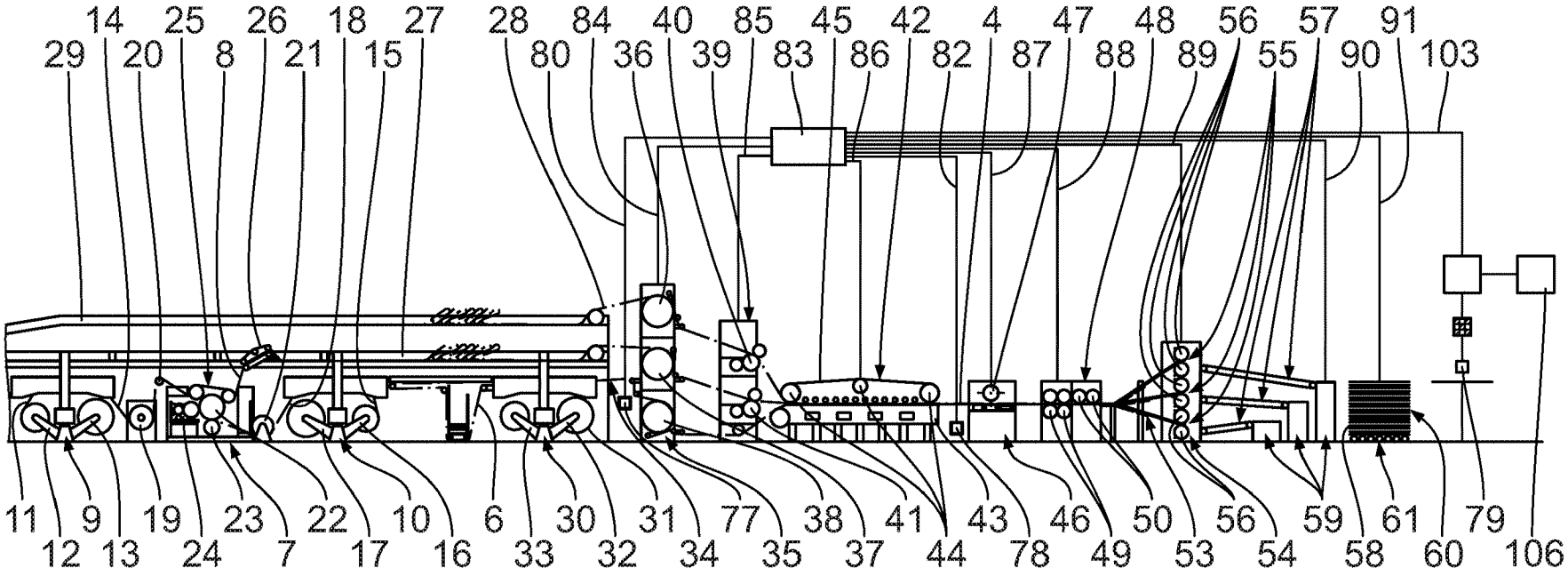
FIG. 1 is a schematic partial lateral view of a corrugated cardboard plant according to the invention.
Figure 2:
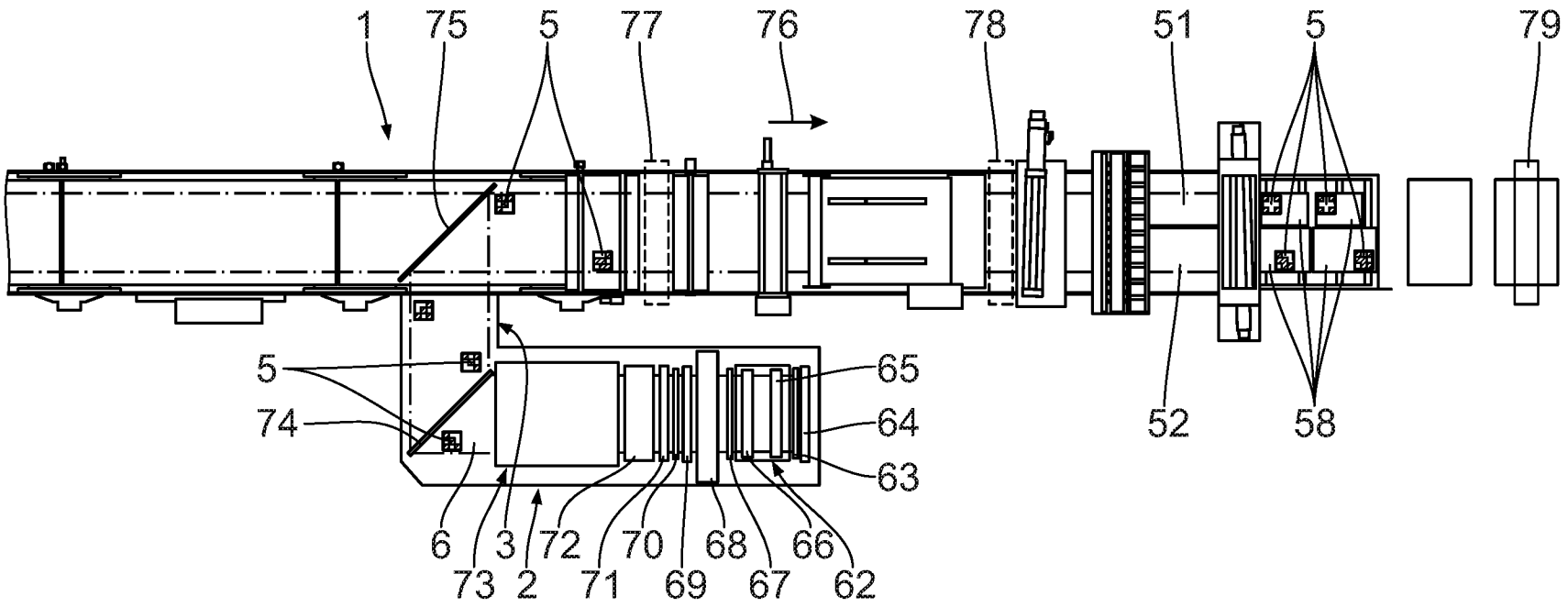
FIG. 2 is a plan view of the corrugated cardboard plant illustrated in FIG. 1.

First referring to FIGS. 1 and 2, a corrugated cardboard plant comprises a corrugated cardboard production line 1 and an individual code imprinting line 2, and an individual code web transfer assembly 3 by way of which the individual code imprinting line 2 is connected to the corrugated cardboard production line 1. A multi-ply continuous corrugated cardboard web 4 is producible in the corrugated cardboard production line 1, while a continuous individual code web 6 provided with corrugated cardboard sheet individual codes 5 can be fabricated in the individual code imprinting line 2. The individual code imprinting line 2 preferably extends in a parallel manner laterally beside the corrugated cardboard production line 1. Alternatively, the individual code imprinting line 2 runs perpendicularly to the corrugated cardboard production line 1, for example, or is integrated in the corrugated cardboard production line 1.

The corrugated cardboard production line 1 comprises a first corrugated cardboard production device 7 for producing a continuous first corrugated cardboard web 8 laminated on one side.

A first cover web splicing device 9 and a first material web splicing device 10 are disposed upstream of the first corrugated cardboard production device 7

The first cover web splicing device 9 comprises a first unwinding unit 12 for unwinding a finite first cover web 11 from a first cover web roll, and a second unwinding unit 13 for unwinding a finite second cover web from a second cover web roll. The finite first cover web 11 and the second cover web by means of a connecting and cutting unit (not illustrated) of the cover web splicing device 9 are connected to one another in order to provide a continuous first cover web 14.

The first material web splicing device 10 is configured in a manner corresponding to that of the first cover web splicing device 9. Said first material web splicing device 10 comprises a third unwinding unit 16 for unwinding a finite first material web 15 from a first material web roll, and a fourth unwinding unit 17 for unwinding a finite second material web from a second material web roll. The finite first material web 15 and the second material web by means of a connecting and cutting unit (not illustrated) of the first material web splicing device 10 are connected to one another in order to provide a continuous first material web 18.

The continuous first cover web 14 is fed to the first corrugated cardboard production device 7 by way of a first heating roller 19 and a first deflection roller 20, while the continuous first material web 18 is fed to the first corrugated cardboard production device 7 by way of a second deflection roller 21.

The first corrugated cardboard production device 7 for generating a continuous first corrugated web having a corrugation from the continuous first material web 18 comprises a grooving roller assembly having a first grooving roller 22 and a second grooving roller 23. The grooving rollers 22, 23 configure a roller gap for guiding through and grooving the continuous first material web 18. The rotation axes of the grooving rollers 22, 23 run so as to be mutually parallel.

In order for the continuous first cover web 14 to be connected to the continuous corrugated first material web or corrugated web 18, respectively, to form the continuous first corrugated cardboard web 8 laminated on one side, the first corrugated cardboard production device 7 has a glue application installation 24 which preferably comprises a glue metering roller, a glue container, and a glue application roller. The glue application roller conjointly with the first grooving roller 22 configures a gap for guiding through and gluing the continuous first corrugated web 18. The glue located in the glue container by way of the glue application roller is applied to tips of the corrugation of the continuous first corrugated web 18. The glue metering roller bears on the glue application roller and serves for configuring a uniform layer of glue on the glue application roller.

The continuous first cover web 14 is subsequently joined to the continuous first corrugated web 18 in the first corrugated cardboard production device 7 for producing the first corrugated cardboard web 8 laminated on one side, said continuous first corrugated web 18 being provided with glue from the glue container.

In order for the continuous first cover web 14 to be pressed against the continuous first corrugated web 18 provided with glue, said continuous first corrugated web 18 in turn in regions bearing on the first grooving roller 22, the first corrugated cardboard production device 7 has a contact pressure module 25. The contact pressure module 25 is favorably embodied as a contact pressure belt module. Said contact pressure module 25 is disposed above the first grooving roller 22. The contact pressure module 25 has two deflection rollers and a continuous contact pressure belt which is guided around the two deflection rollers. Alternatively, the contact pressure module 25 has at least one contact pressure roller, for example.

The first grooving roller 22 in regions engages from below into a space between the two deflection rollers of the contact pressure module 25, on account of which the contact pressure belt is deflected by the first grooving roller 22. The contact pressure belt presses against the continuous first cover web 14 which in turn is pressed against the continuous first corrugated web 18 that is provided with glue and bears on the first grooving roller 22.

For the intermediate storage and buffering of the continuous first corrugated cardboard web 8 laminated on one side, the latter by way of a first elevated transportation installation 26 is fed to a first storage device 27 where said continuous first corrugated cardboard web 8 laminated on one side configures loops.

The corrugated cardboard production line 1 here furthermore has a second corrugated cardboard production device (not illustrated) which is configured in a manner corresponding to that of the first corrugated cardboard production device 7. A second cover web splicing device (not illustrated) and a second material web splicing device (not illustrated) are disposed upstream of the second corrugated cardboard production device, said second cover web splicing device and said second material web splicing device being configured in a manner corresponding to that of the first cover web splicing device 9 or of the first material web splicing device 10, respectively, the latter two having already been described. The second corrugated cardboard production device is capable of generating a continuous second corrugated cardboard web 28 laminated on one side from a continuous second cover web and material web.

The second corrugated cardboard web 28 laminated on one side is fed to a second storage device 29 where said second corrugated cardboard web 28 laminated on one side configures loops.

The corrugated cardboard production line 1 moreover has a lamination web splicing device 30 which comprises a fifth unwinding unit 32 for unwinding a finite first lamination web 31 from a first lamination web roll, and a sixth unwinding unit 33 for unwinding a finite second lamination web from a second lamination web roll. The finite first lamination web 31 and the finite second lamination web by means of a splicing installation (not illustrated) of the lamination web splicing device 30 are connected to one another for providing a continuous lamination web 34.

The lamination web splicing device 30 moreover ideally comprises a second splicing installation (not illustrated). The continuous individual code web 6 is capable of being spliced to the continuous lamination web 34 by means of the second splicing installation such that the individual code web 6 in the spliced state then quasi forms the lamination web 34. The continuous individual code web 6 is capable of being spliced to the finite first lamination web 31 or the second lamination web by means of the second splicing installation. In terms of the detailed construction and the exact functioning of the lamination web splicing device 30, reference is made to DE 10 2015 218 321.1 and corresponding US 2017/0088380 A1, the entire contents of each of the references being incorporated herein by reference.

The corrugated cardboard production line 1 downstream of the storage devices 27, 29 and of the lamination web splicing device 30 has a preheating device 35 which comprises three pre-heating rollers 36, 37, 38 disposed on top of one another. The continuous glued corrugated cardboard webs 8, 28 laminated on one side and the continuous lamination web 34, or individual code web 6, respectively, which wrap around the respective preheating roller 36, 37, or 38, respectively, are fed to the pre-heating device 35. Depending on the order, the individual code web 6 imprinted with corrugated cardboard sheet individual codes 5 or the actual lamination web 34 which is free of corrugated cardboard sheet individual codes 5 can be fed to the pre-heating device 35.

The corrugated cardboard production line 1 downstream of the pre-heating device 35 has a gluing unit 39 having gluing rollers 40, 41 which are partially submerged in a respective glue bath. A glue metering roller bears on each gluing roller 40, 41 in order for a uniform layer of glue to be configured on the adjacent gluing roller 40, 41. The first corrugated cardboard web 8 laminated on one side, by way of the corrugated web 18 thereof, contacts the gluing roller 41 such that the corrugation of said corrugated web 18 is provided with glue from the glue bath. The second corrugated cardboard web 28 laminated on one side, by way of the corrugated web thereof, contacts the gluing roller 40 such that the corrugation of said corrugated web is provided with glue from the associated glue bath. The individual code web 6, or the actual lamination web 34, respectively, remains without glue in the gluing unit 39.

The corrugated cardboard production line 1 downstream of the gluing unit 39 has a connection device 42 which is configured as the heating/pressing device and comprises a horizontally running heating table 43. A continuous pressing belt 45 which is guided around guide rollers 44 is disposed so as to be adjacent to the heating table 43. A pressing gap through which the corrugated cardboard webs 8, 28 laminated on one side and the continuous lamination web 6, or individual code web 34, respectively, are guided while forming the continuous corrugated cardboard web 4 is configured between the pressing belt 45 and the heating table 43. The corrugated cardboard web 4 here has a total of five plies.

The corrugated cardboard production line 1 downstream of the connection device 42 has a short transverse cutting device 46 which comprises at least one transverse cutting roller 47 having a radially projecting knife beam (not illustrated). The short transverse cutting device 46 serves for cutting out rejects from the continuous corrugated cardboard web 4.

The corrugated cardboard production line 1 downstream of the short transverse cutting device 46 has a longitudinal cutting/grooving device 48 for longitudinally cutting and grooving the continuous corrugated cardboard web 4. The longitudinal cutting/grooving device 48 has two grooving stations 49 disposed behind one another, and two longitudinal cutting stations 50 disposed behind one another. The grooving stations 49 have grooving tools which are in each case disposed in pairs on top of one another, the corrugated cardboard web 4 being guided through therebetween. The longitudinal cutting stations 50 have in each case knives which are drivable in a rotating manner and which can be brought to engage with the corrugated cardboard web 4 in order for the latter to be longitudinally severed. Continuous part-webs 51, 52 which initially still run beside one another can be generated from the corrugated cardboard web 4 in the longitudinal cutting/grooving device 48.

The corrugated cardboard production line 1 downstream of the longitudinal cutting/grooving device 48 has a turnout 53 in order for the part-webs 51, 52 of the corrugated cardboard web 4 to be conveyed to different planes.

The corrugated cardboard production line 1 downstream of the turnout 53 has a transverse cutting device 54 having transverse cutting installations 55 which are disposed on top of one another. Each transverse cutting installation 55 comprises two knife beam rollers 56, disposed in pairs, having radially projecting knife beams. The knife beams of the knife beam rollers 56 of a transverse cutting installation 55 interact in order for the part-webs 51, 52 to be transversely cut.

A conveyor belt installation 57 is disposed downstream of each transverse cutting installation 55, in order for the corrugated cardboard sheets 58 generated in the latter from the part-webs 51, 52 to be conveyed further.

A depositing device 59 which is favourably height-adjustable is disposed downstream of each conveyor belt installation 57. The corrugated cardboard sheets 58 are stackable on top of one another to form stacks 60 in the depositing devices 59.

A stack handling device 61 for handling, such as transporting and/or checking, the stacks 60 is disposed downstream of the depositing devices 59.

The individual code imprinting line 2 comprises an individual code web splicing device 62 which is configured in a manner corresponding to that of the first cover web splicing device 9, or of the first material web splicing device 10, respectively. The individual code web splicing device 62 thus has a first unwinding unit for unwinding a finite first individual code web from a first individual code web roll, and a second unwinding unit for unwinding a finite second individual code web from a second individual code web roll. The finite first and second individual code webs by means of a connecting and cutting unit (not illustrated) of the individual code web splicing device 62 are connected to one another in order for the continuous individual code web 6 to be provided.

The individual code imprinting line 2 downstream of the individual code web splicing device 62 has a pre-coating application device 63 which is assigned to the continuous individual code web 6 and which applies a planar pre-coating (not illustrated) to an external side of the individual code web 6. The planar pre-coating covers the continuous individual code web 6 in particular essentially over the entire area on the external side of the latter, said external side in the case of the finished corrugated cardboard web 4 also forming an external side.

The individual code web imprinting line 2 downstream of the pre-coating application device 63 has a pre-coating drying device 64 which is assigned to the continuous individual code web 6 and which dries the continuous individual code web 6 provided with the pre-coating on the external side, or dries the pre-coating, respectively.

The individual code web imprinting line 2 downstream of the pre-coating drying device 64 has a traction unit 65 which is assigned to the continuous individual code web 6 and which conveys the continuous individual code web 6, or draws the latter away from the individual code web splicing device 62, respectively.

The individual code web imprinting line 2 downstream of the traction unit 65 has a corona pre-treatment device 66 which is assigned to the continuous individual code web 6. The external side of the continuous individual code web 6 is exposed to an electrical corona discharge by the corona pre-treatment device 66, this leading to an oxidation of the surface of said external side.

The individual code web imprinting line 2 downstream of the corona pre-treatment device 66 has a cleaning device 67 which is assigned to the continuous individual code web 6 and which at least on the external side cleans the continuous individual code web 6. The individual code web imprinting line 2 downstream of the cleaning device 67 has an individual code digital printing device 68 which is assigned to the continuous individual code web 6 and which on the external side imprints the corrugated cardboard sheet individual codes 5 on the continuous individual code web 6, or on the dried pre-coating, respectively. The digital printing device 68 imprints the individual code web 6 in such a manner that each corrugated cardboard sheet 58 has at least one corrugated cardboard sheet individual code 5 on the external side. Said digital printing device 68, in addition to the corrugated cardboard sheet individual codes 5, is favorably also capable of imprinting other imprints such as colors, images, notices or the like on the individual code web 6.

The individual code web imprinting line 2 downstream of the digital printing device 68 has an individual code drying device 69 which is assigned to the continuous individual code web 6 and which dries the printed continuous individual code web 6, or the corrugated cardboard sheet individual codes 5 of the latter, respectively.

The individual code web imprinting line 2 downstream of the individual code drying device 69 has a lacquer application unit 70 which is assigned to the continuous individual code web 6, for applying across the entire area at least one transparent cover lacquer layer (not illustrated) to the external side on the continuous individual code web 6. The at least one cover lacquer layer protects the corrugated cardboard sheet individual codes 5 from damage.

The individual code web imprinting line 2 downstream of the lacquer application unit 70 has a lacquer drying device 71 which is assigned to the continuous individual code web 6 and which dries the painted continuous individual code web 6, or the at least one cover lacquer layer thereof, respectively.

The individual code imprinting line 2 downstream of the lacquer drying device 71 has a re-humidifier device 72 which is assigned to the continuous individual code web 6 and which humidifies the continuous individual code web 6 at least on the external side, or on that side that is to be connected to the corrugated cardboard web 8, 28 laminated on one side, respectively.

The individual code web imprinting line 2 moreover has an individual code web storage device 73 for storing the in particular imprinted individual code web 6.

The individual code web transfer assembly 3 which comprises a first deflection bar 74 and a second deflection bar 75 is disposed downstream of the individual code web storage device 73.

The individual code web 6 at the first deflection bar 74 is deflected by 90° and reversed. The individual code web 6 by the second deflection bar 75 which is located within the corrugated cardboard production line 1 is deflected by 90° and reversed in the conveying direction 76 of the corrugated cardboard production line 1.

A first individual code reading device 77 is disposed in the corrugated cardboard production line 1. The first individual code reading device 77 is disposed upstream of the preheating device 35 and downstream of the storage devices 27, 29. The first individual code reading device 77 is disposed between the individual code web transfer assembly 3 and the preheating device 35. Said first individual code reading device 77 is assigned to the continuous lamination web 34, or to the individual code web 6, respectively, on the external side. The first individual code reading device 77 serves for detecting the corrugated cardboard sheet individual codes 5. Controlling of processing devices that are disposed downstream is performed based on the corrugated cardboard sheet individual codes 5 that are detected by said first individual code reading device 77.

In the corrugated cardboard production line 1 a second individual code reading device 78 is disposed downstream of the connection device 42. The second individual code reading device 78 is disposed upstream of the transverse cutting device 54, more preferably upstream of the longitudinal cutting/grooving device 48, more preferably upstream of the short transverse cutting device 46. The second individual code reading device 78 is assigned to the individual code web 6, or to the lamination web 34, respectively, on the external side. The second individual code reading device 78 detects defective corrugated cardboard sheets 58, or reject sheets, respectively.

The corrugated cardboard plant moreover has a third individual code reading device 79 which is disposed downstream of the stack handling device 61. The third individual code reading device 79 detects the finished corrugated cardboard sheets 58 after the stack handling device 61.

Each individual code reading device 77, 78, 79 by way of a first, second, and third information line 80, 82 and 103, respectively, in terms of information is connected to a superordinate electronic control device 83 such that the item/items of useful information of the corrugated cardboard sheet individual code 5 read by the respective individual code reading device 77, 78 or 79, respectively, is/are transmittable to the control device 83.

Each individual code reading device 77, 78, 79 is favorably assigned an evaluation unit (not illustrated). The latter can be a component part of the individual code reading device 77, 78, or 79, respectively. Alternatively, said evaluation unit is disposed downstream of the respective individual code reading device 77, 78, or 79, respectively. Alternatively, the control device 83 includes at least one respective evaluation unit.

The pre-heating device 35 in terms of information is connected to the control device 83 by way of a fourth information line 84.

The gluing unit 39 in terms of information is connected to the control device 83 by way of a fifth information line 85.

The connection device 42 in terms of information is connected to the control device 83 by way of a sixth information line 86.

The short transverse cutting device 46 in terms of information is connected to the control device 83 by way of a seventh information line 87.

The longitudinal cutting/grooving device 48 in terms of information is connected to the control device 83 by way of an eighth information line 88.

The transverse cutting device 54 in terms of information is connected to the control device 83 by way of a ninth information line 89.

The depositing devices 59 in terms of information are connected to the control device 83 by way of a tenth information line 90.

The stack handling device 61 in terms of information is connected to the control device 83 by way of an eleventh information line 91.

Wireless connections are possible instead of wired information lines 80 to 82, 84 to 91, 103.

The detection of the corrugated cardboard sheet individual codes 5 and the processing associated therewith in the corrugated cardboard plant will be described hereunder.

The first individual printed code reading device 77 reads the corrugated cardboard sheet individual codes 5 on the individual code web 6 that is guided past there. The read corrugated cardboard sheet individual codes 5 are evaluated in the associated evaluation unit, and the item/items of useful information gained therefrom is/are fed to the control device 83 by way of the first information line 80.

According to this/these item/items of useful information, the control device 83 actuates individually the pre-heating device 35 by way of the fourth information line 84, the gluing unit 39 by way of the fifth information line 85, and/or the connection device 42 by way of the sixth information line 86. The pre-heating device 35, the gluing unit 39, and/or the connection device 42 are/is readjusted or activated if required, respectively, according to the read item/items of useful information.

The second individual printed code reading device 78 reads the corrugated cardboard sheet individual codes 5 on the individual code web 6 guided past there. The read corrugated cardboard sheet individual codes 5 are evaluated in the associated evaluation unit, and the item/items of useful information gained therefrom is/are fed to the control device 83 by way of the second information line 82.

According to this/these item/items of useful information, the control device 83 correspondingly actuates individually the short transverse cutting device 46 by way of the seventh information line 87, the longitudinal cutting/grooving device 48 by way of the eighth information line 88, the transverse cutting device 54, or the respective transverse cutting device/devices 55, respectively, by way of the ninth information line 89, the respective depositing device/devices 59 by way of the tenth information line 90, and/or the stack handling device 61 by way of the eleventh information line 91. The short transverse cutting device 46, the longitudinal cutting/grooving device 48, the transverse cutting device 54, or respectively the respective transverse cutting device/devices 55, the respective depositing device/devices 59, and/or the stack handling device 61 are/is readjusted or activated if required, respectively, according to the read item/items of useful information.

The third individual printed code reading device 79 reads the corrugated cardboard sheet individual codes 5 on the corrugated cardboard sheets 58 conveyed past the former. The read corrugated cardboard sheet individual codes 5 are evaluated in the associated evaluation unit, and the item/items of useful information gained therefrom is/are fed to the control device 83 by way of the third information line 103. In particular, the position of the corrugated cardboard sheets 58 is thus trackable. Said item/items of useful information is/are preferably also fed to at least one downstream processing/further processing station, or to the controller/controllers 106 thereof, respectively.

In the extreme case, at least one processing device 35, 39, 42, 46, 48, 54, 59, 61 is individually readjusted for each corrugated cardboard sheet 58. However, often only individual processing devices 35, 39, 42, 46, 48, 54, 59, 61 or groups are readjusted.

Figure 3:
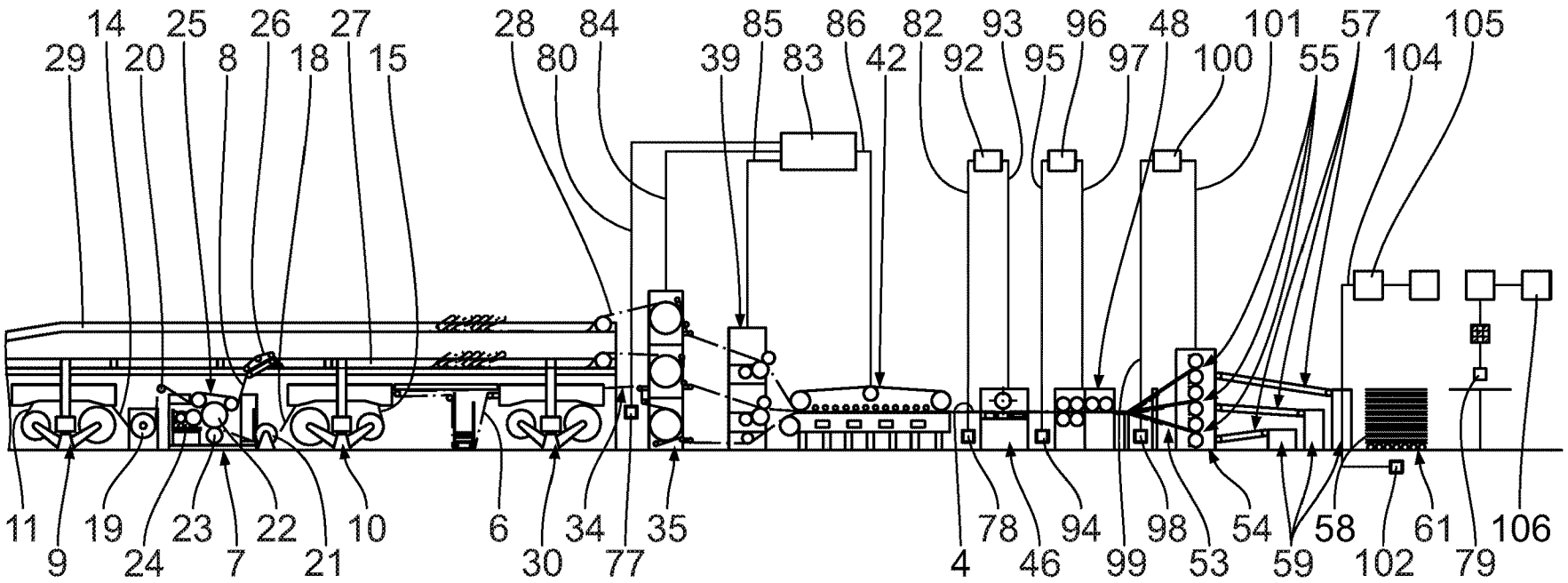
FIG. 3 is a schematic partial lateral view of a corrugated cardboard plant according to the invention, according to a second embodiment.

A second embodiment will be described hereunder with reference to FIG. 3, wherein reference is explicitly made to the previous description. Parts of identical construction at all times have the same reference signs as in the previous embodiment.

As opposed to the previous embodiment, the second individual printed code reading device 78 in terms of information is connected to a short transverse cutting device control device 92 by way of the second information line 82, said short transverse cutting device control device 92 in turn in terms of information being connected to the short transverse cutting device 46 by way of a twelfth information line 93.

A fourth individual code reading device 94 which is assigned to the lamination web 34, or the individual code web 6, respectively, is disposed between the short transverse cutting device 46 and the longitudinal cutting/grooving device 48. The fourth individual code reading device 94 in terms of information is connected to a longitudinal cutting/grooving device controller 96 by way of a thirteenth information line 95, said longitudinal cutting/grooving device controller 96 in turn in terms of information being connected to the longitudinal cutting/grooving device 48 by way of a fourteenth information line 97.

A fifth individual printed code reading device 98 is disposed between the longitudinal cutting/grooving device 48 and the transverse cutting device 54. Said fifth individual printed code reading device 98 is in each case assigned to the lamination web 34, or individual code web 6, respectively. The fifth individual printed code reading device 98 in terms of information is connected to a transverse cutting device control device 100 by way of a fifteenth information line 99, said transverse cutting device control device 100 in turn in terms of information being connected to the transverse cutting device 54 by way of a sixteenth information line 101.

The stack handling device 61 is assigned a sixth individual code reading device 102 which in terms of information is connected to a stack handling device controller 105 by way of a seventeenth information line 104 and is assigned to the respective lamination web 34 or individual code web 6, respectively.

The connections by way of the information lines 80, 82, 85, 86, 93, 95, 97, 101, 104 can also be implemented so as to be wireless.

According to the corrugated cardboard sheet individual code 5 read by the fourth individual printed code reading device 94, the longitudinal cutting/grooving device controller 96 actuates individually the longitudinal cutting/grooving device 48 by way of the information line 97 and readjusts said longitudinal cutting/grooving device 48 if required.

According to the corrugated cardboard sheet individual code 5 read by the fifth individual printed code reading device 98, the transverse cutting device control device 100 actuates individually the transverse cutting device 54, or the transverse cutting installation/installations 55, respectively, by way of the information line 101, and readjusts said device or installation/installations, respectively, if required. The transverse cutting device control device 100 moreover is capable of controlling by way of which plane or transverse cutting installation/installations 55, respectively, the corrugated cardboard sheet 58 is directed. Each corrugated cardboard sheet 58 is thus capable of being fed to a defined, or specific, respectively, stack 60.

The sixth individual printed code reading device 102 there reads the corrugated cardboard sheet individual codes 5. The stack handling device controller 105 receives respective items of useful information by way of the seventeenth information line 104. It can thus be established where the respective corrugated cardboard sheet 58 is located. These items of useful information are also capable of being fed to at least one downstream processing/further processing station, or to the controller/controllers 106 thereof, respectively.

According to an alternative embodiment, the corrugated cardboard plant, or the corrugated cardboard production line, respectively, has at least one stocking installation for stocking and dispensing at least one web already provided with corrugated cardboard sheet individual codes 5 for use as a lamination web and/or cover web of the at least three-ply corrugated cardboard web 4. The at least one stocking installation is configured as a splicing device, for example.

While specific embodiments of the invention have been shown and described in detail to illustrate the application of the principles of the invention, it will be understood that the invention may be embodied otherwise without departing from such principles.

The invention claimed is:

1. A method, comprising:

producing at least one corrugated cardboard web laminated on one side, having a respective corrugated web and cover web, via at least one corrugated cardboard production device;

connecting the at least one corrugated cardboard web laminated on one side and a lamination web to one another, while forming an at least three-ply corrugated cardboard web, via a connection device disposed downstream of the at least one corrugated cardboard production device;

generating corrugated cardboard sheets from the at least three-ply corrugated cardboard web via at least one cutting device;

reading corrugated cardboard sheet individual codes on at least one of at least one of the webs of the at least three-ply corrugated cardboard web, at least one of the webs for forming the at least three-ply corrugated cardboard web and the corrugated cardboard sheets via at least one individual code reading device, wherein at least one of the corrugated cardboard sheet individual codes represent information carriers, at least one item of useful information thereof being readable on demand, and establish a connection to a database where the at least one item of useful information is stored;

individually actuating a short transverse cutting device via at least one corrugated cardboard plant control device for diverting a defective piece of the at least three-ply corrugated cardboard web in a manner corresponding to at least one read associated corrugated cardboard sheet individual code, the at least one corrugated cardboard plant control device being connected to the at least one individual code reading device, wherein the short transverse cutting device comprises at least one transverse cutting roller.

2. A method according to claim 1, further comprising:

providing at least one individual code printing device upstream of the at least one cutting device for printing at least one of at least one of the webs of the at least three-ply corrugated cardboard web and at least one of the webs for forming the at least three-ply corrugated cardboard web having corrugated cardboard sheet individual codes.

3. A method according to claim 2, wherein the at least one individual code printing device is disposed in an individual code imprinting line.

4. A method according to claim 1, wherein the at least one corrugated cardboard plant control device is configured to individually actuate the cutting device in a manner corresponding to at least one read associated corrugated cardboard sheet individual code.

5. A method according to claim 1, further comprising providing at least one stocking installation for stocking at least one web already provided with corrugated cardboard sheet individual codes, as a component part of the at least three-ply corrugated cardboard web.

6. A method according to claim 1, wherein the corrugated cardboard sheet individual codes of at least two of the corrugated cardboard sheets differ from one another.

7. A method according to claim 1, wherein the at least one corrugated cardboard plant control device is configured to track the corrugated cardboard sheet individual codes.

8. A method according to claim 7, wherein the at least one corrugated cardboard plant control device actuates individually at least one processing device in a manner corresponding to at least one read corrugated cardboard sheet individual code.

9. A method according to claim 1, wherein the at least one corrugated cardboard plant control device is configured to individually actuate a pre-heating device for pre-heating at least one web for forming the at least three-ply corrugated cardboard web in a manner corresponding to at least one read associated corrugated cardboard sheet individual code.

10. A method according to claim 1, wherein the at least one corrugated cardboard plant control device is configured to individually actuate a gluing unit for applying glue to at least one web for forming the at least three-ply corrugated cardboard web in a manner corresponding to at least one read associated corrugated cardboard sheet individual code.

11. A method according to claim 1, wherein the at least one corrugated cardboard plant control device is configured to individually actuate the connection device in a manner corresponding to at least one read associated corrugated cardboard sheet individual code.

12. A method according to claim 4, wherein the at least one corrugated cardboard plant control device is configured to individually actuate the cutting device to divert a defective corrugated cardboard sheet.

13. A method according to claim 1, wherein the at least one corrugated cardboard plant control device is configured to automatically issue an order for reproducing the defective piece of the at least three-ply corrugated cardboard web.

14. A method according to claim 1, wherein the at least one corrugated cardboard plant control device is configured to individually actuate a longitudinal cutting/grooving device for longitudinally cutting and grooving the at least three-ply corrugated cardboard web in a manner corresponding to at least one read associated corrugated cardboard sheet individual code.

15. A method according to claim 1, wherein the at least one corrugated cardboard plant control device is configured to individually actuate at least one corrugated cardboard sheet depositing device for depositing the corrugated cardboard sheets in a manner corresponding to at least one read associated corrugated cardboard sheet individual code.

16. A method according to claim 1, wherein the at least one corrugated cardboard plant control device is configured to individually actuate a stack handling device for handling the corrugated cardboard sheets stacked in at least one stack in a manner corresponding to at least one read associated corrugated cardboard sheet individual code.

17. A method according to claim 1, wherein a plurality of processing devices are present, wherein at least two of the processing devices are connected to one another and communicate with one another.

18. A method, comprising:

producing at least one corrugated cardboard web laminated on one side, having a respective corrugated web and cover web, via at least one corrugated cardboard production device;

connecting the at least one corrugated cardboard web laminated on one side and a lamination web to one another, while forming an at least three-ply corrugated cardboard web, via a connection device disposed downstream of the at least one corrugated cardboard production device;

generating corrugated cardboard sheets from the at least three-ply corrugated cardboard web via at least one cutting device;

reading corrugated cardboard sheet individual codes on at least one of at least one of the webs of the at least three-ply corrugated cardboard web, at least one of the webs for forming the at least three-ply corrugated cardboard web and the corrugated cardboard sheets via at least one individual code reading device, wherein at least one of the corrugated cardboard sheet individual codes represent information carriers, at least one item of useful information thereof being readable on demand, and establish a connection to a database where the at least one item of useful information is stored; and individually actuating a gluing unit via at least one corrugated cardboard plant control device for applying glue to at least one web for forming the at least three-ply corrugated cardboard web in a manner corresponding to at least one read associated corrugated cardboard sheet individual code, wherein at least one of a quantity of the glue and a width of the glue that is to be applied on the at least one web to be glued is variable in an individual manner by the gluing unit.

19. A method, comprising:

producing at least one corrugated cardboard web laminated on one side, having a respective corrugated web and cover web, via at least one corrugated cardboard production device;

connecting the at least one corrugated cardboard web laminated on one side and a lamination web to one another, while forming an at least three-ply corrugated cardboard web, via a connection device disposed downstream of the at least one corrugated cardboard production device;

generating corrugated cardboard sheets from the at least three-ply corrugated cardboard web via at least one cutting device;

reading corrugated cardboard sheet individual codes on at least one of at least one of the webs of the at least three-ply corrugated cardboard web, at least one of the webs for forming the at least three-ply corrugated cardboard web and the corrugated cardboard sheets via at least one individual code reading device, wherein at least one of the corrugated cardboard sheet individual codes represent information carriers, at least one item of useful information thereof being readable on demand, and establish a connection to a database where the at least one item of useful information is stored; and individually actuating the connection device in a manner corresponding to at least one read associated corrugated cardboard sheet individual code via at least one corrugated cardboard plant control device connected to the at least one individual code reading device, wherein at least one of a heating temperature, a web temperature and contact pressure is variable in an individual manner by the connection device, the connection device comprising a horizontally running heating table.

20. A method, comprising:

producing at least one corrugated cardboard web laminated on one side, having a respective corrugated web and cover web, via at least one corrugated cardboard production device;

connecting the at least one corrugated cardboard web laminated on one side and a lamination web to one another, while forming an at least three-ply corrugated cardboard web, via a connection device disposed downstream of the at least one corrugated cardboard production device;

generating corrugated cardboard sheets from the at least three-ply corrugated cardboard web via at least one cutting device;

reading corrugated cardboard sheet individual codes on at least one of at least one of the webs of the at least three-ply corrugated cardboard web, at least one of the webs for forming the at least three-ply corrugated cardboard web and the corrugated cardboard sheets via at least one individual code reading device, wherein at least one of the corrugated cardboard sheet individual codes represent information carriers, at least one item of useful information thereof being readable on demand, and establish a connection to a database where the at least one item of useful information is stored; and individually actuating a pre-heating device via at least one corrugated cardboard plant control device for pre-heating at least one web for forming the at least three-ply corrugated cardboard web in a manner corresponding to at least one read associated corrugated cardboard sheet individual code, the at least one corrugated cardboard plant control device being connected to the at least one individual code reading device, wherein at least one of a heating and a temperature of the at least one web to be heated is variable in an individual manner by the pre-heating device.

21. A method, comprising:

producing at least one corrugated cardboard web laminated on one side, having a respective corrugated web and cover web, via at least one corrugated cardboard production device;

connecting the at least one corrugated cardboard web laminated on one side and a lamination web to one another, while forming an at least three-ply corrugated cardboard web, via a connection device disposed downstream of the at least one corrugated cardboard production device;

generating corrugated cardboard sheets from the at least three-ply corrugated cardboard web via at least one cutting device;

reading corrugated cardboard sheet individual codes on at least one of at least one of the webs of the at least three-ply corrugated cardboard web, at least one of the webs for forming the at least three-ply corrugated cardboard web and the corrugated cardboard sheets via at least one individual code reading device, wherein at least one of the corrugated cardboard sheet individual codes represent information carriers, at least one item of useful information thereof being readable on demand, and establish a connection to a database where the at least one item of useful information is stored; and individually actuating a stack handling device via at least one corrugated cardboard plant control device for handling the corrugated cardboard sheets stacked in at least one stack in a manner corresponding to at least one read associated corrugated cardboard sheet individual code, the at least one corrugated cardboard plant control device being connected to the at least one individual code reading device, wherein a diversion of the generated stacks away from the corrugated cardboard plant is at least one of adaptable and controllable in an individual manner by the stack handling device.

* * * * *